United States Patent [19]

Roesch

[11] Patent Number: 4,655,054

[45] Date of Patent: Apr. 7, 1987

[54] INTERCHANGEABLE JEWELRY ASSEMBLY

[76] Inventor: Marcia G. Roesch, 3268 Observatory Ave., Cincinnati, Ohio 45208

[21] Appl. No.: 717,382

[22] Filed: Mar. 29, 1985

[51] Int. Cl.[4] ..... A44C 7/00

[52] U.S. Cl. ..... 63/13; 63/20

[58] Field of Search ..... 63/12, 13, 20, 23; 24/90.5, 103, 155 R

[56] References Cited

U.S. PATENT DOCUMENTS

| | | | |
|---|---|---|---|
| 157,513 | 12/1874 | Harland | 24/103 |
| 342,182 | 5/1886 | Chew | 24/103 |
| 588,675 | 8/1897 | Conkle | 24/155 R |
| 1,283,843 | 11/1918 | Makowski | 24/155 R |
| 3,071,938 | 1/1963 | Davidson | 63/13 |
| 4,221,118 | 9/1980 | Chicckine | 63/13 |

*Primary Examiner*—Richard J. Johnson
*Attorney, Agent, or Firm*—Frost & Jacobs

[57] ABSTRACT

An interchangeable jewelry assembly includes a jewelry ornament with a vertically oriented fastening loop affixed to the rear surface thereof. An elongated serpentine fastening structure includes an enlarged outboard end having a dimension greater than the internal dimension of the fastening loop so as to prevent the enlarged outboard end from passing through the fastening loop. The section of the elongated fastening structure proximal to the enlarged end is defined by a U-shaped supporting loop perpendicularly joined to the remaining inboard portion of the elongated structure. The ornament of the jewelry assembly may be used for a variety of different jewelry pieces such as an earring, a brooch, or a necklace ornament.

5 Claims, 7 Drawing Figures

INTERCHANGEABLE JEWELRY ASSEMBLY

TECHNICAL FIELD

The invention relates generally to jewelry and more particularly concerns an interchangeable ornamental jewelry assembly wherein a unique interconnection between an individual jewelry ornament and a fastening element enhances the ornament's utility. The invention will be specifically disclosed in connection with a jewelry ornament which may be used as an earring, a brooch or necklace ornament.

BACKGROUND OF THE INVENTION

It is a widely practiced custom throughout many areas of the world for women and, in some instances, men to wear ornamental jewelry. Each jeweled ornament is usually singularly dedicated for use as only one type of jewelry piece. This jewelry may take a variety of different forms which may be worn directly attached to the wearer, as for example in the case of earrings, or may be attached to the wearer's clothes in stickpin fashion. One example of a jewelry ornament attached to the wearer's clothes is a broach, which may be attached to a lapel of a jacket worn by the user. Although it is common to have a set of different, but matching, jewelry pieces having some common characteristics, each of the different jewelry pieces in a set generally has its own ornament and is structurally and functionally independent from the other pieces in the set.

Although this prior art practice of using singularly dedicated jewelry ornaments is quite acceptable for relatively inexpensive costume jewelry, it has serious economic consequences for fine jewelry where the cost of the jewelry ornament is great. The high economic costs of fine jewelry ornaments has significantly limited the sales potential for such ornaments. When purchased, the jewelry ornament may be worn only for the singularly dedicated use for which the particular jewelry piece is designed. Consequently, the per use economic cost of the jewelry is extraordinarily high for those pieces having expensive jewelry ornaments.

There have been many attempts in the prior art to make interchangeable jewelry assemblies. However, for the most part, the interchangability in products resulting from these attempts has been limited to interchanging a plurality of different ornaments on a particular and specific type of fastening element. While clearly useful, the structures resulting from these efforts do little to address the economic problems associated with the use of expensive jewelry ornaments. Instead of permitting several uses for a single ornament, these prior art efforts have generally permitted only the use of multiple ornaments with one or several fastening elements. The reason for this shortcoming of prior art jewelry assemblies is that different types of jewelry pieces are supported in different ways, and it is difficult to design a fastening means capable of accommodating such diverse requirements.

For example, in U.S. Pat. No. 3,071,938 to Davidson, a continuous scroll-like wire with a guard on its outboard portion is inserted through the earlobe to support a loop-type jewelry ornament. The scroll-like wire is run through a loop of the jewelry ornament before insertion of the wire into the earlobe. The loop of the drop ornament is slidable on a section of the wire, but is prevented from sliding off by the guard at one end, and by the earlobe at the opposite end. Once the wire is removed from the earlobe, the drop ornament may be removed and replaced with another drop ornament having a similar loop. However, no provision is made to use any of the ornaments as any type of jewelry piece besides earrings. Additional structures for detachably mounting a plurality of different drop ornaments upon a common earring stud or earring fastener are also disclosed in U.S. Pat. Nos. 2,797,561 to Vaughn and 3,116,616 to Bangs.

In U.S. Pat. No. 3,443,398 to King, Jr., an interchangeable earring assembly is disclosed which allows the wearer to interchange the elements of conventional pierced earrings with modified pierced earrings for attaching ornamental drops. This interchangeability is achieved in the King, Jr. patent through the use of specially designed thin concave dish-type adapters. Like the previously discussed references, the King Jr. patent does not disclose a structure permitting the earring ornament to be used as any type of jewelry piece except an earring.

Additionally, chain type necklaces and bracelets of the prior art are frequently used to support drop type jewelry ornaments which are secured to the chain of the necklace or bracelet by horizontal loops fixedly secured to the jewelry ornaments. To a limited extent, these ornaments may be interchangeably used with a necklace chain or a bracelet chain. It may even be possible to utilize some of these necklace jewelry ornaments having horizontal loops affixed thereto with some of the loop supported earring assemblies disclosed in the above-identified patents. However, none of these loop supported drop-type jewelry ornaments have been universally interchangeable, and none are readily adaptable for use as brooch, for example.

An additional problem with the conventional drop-type jewelry ornaments of the prior art is that the loops used to connect these ornaments to chains or earring studs are readily visable and aesthetically detract from the jewelry piece. Such concern over asthetics has strongly discouraged the use of such a simple horizontal loop connectors for fine jewelry ornaments, for the use of the loop may detract from the ornament's aesthetic appeal and significantly reduce the economic value of the ornament. The concern over economic loss is particularly pronounced when the ornament is a fine jewelry piece, as the potential for economic loss increases in proportion to the value of the jewelry ornament. For these reasons, most designers of fine jewelry seldom use such loops to secure their jewelry to the wearer or to the wearer's clothing.

SUMMARY OF THE INVENTION

Accordingly, it is a primary object of the present invention to provide an aesthetically unobjectionable interchangeable jewelry assembly which may be used to increase the utilization of individual jewelry ornaments.

It is another object of the invention to provide an interchangeable jewelry assembly permitting a relatively expensive jewelry ornament to be used with a wide variety of different types of fastening elements.

Yet another object of the present invention is to provide an interchangeable jewelry assembly having a non-dedicated jewelry ornament and a plurality of different fastening elements capable of supporting the ornament with respect to a variety of different support structures in a variety of different orientations.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an interchangeable jewelry assembly is provided which includes a jewelry ornament with a face surface, a rear surface opposite the face surface, and a peripheral side surface separating the face and rear surface. A fastening loop is secured to the rear surface of the jewelry ornament. This fastening loop has a predetermined internal dimension and is disposed in a plane substantially perpendicular to the rear surface. A fastening element adapted for interconnecting with the fastening loop and supporting said jewelry ornament upon a support is provided for cooperating with fastening loop. This fastening element includes a single elongated structure arranged in a serpentine configuration. The elongated serpentine structure has an enlarged outboard end with a dimension greater than the predetermined internal dimension of the fastening loop. As so dimensioned, the fastening loop prevents the enlarged outboard end of the elongated element from passing through the fastening loop.

In accordance with one of the principal aspects of the invention, the section of the elongated fastening structure proximal to the enlarged end is defined by a U-shaped supporting loop perpendicularly joined to the remaining inboard portion of the elongated structure. As used in the present specification and claims, a direction is perpendicular to the U-shaped loop when it is substantially perpendicular to the plane defined by the U-shaped loop.

In accordance with another aspect of the invention, an inboard section of elongated structure is substantially linear.

In accordance with one specific aspect of the invention, the assembly may be used as a brooch. In this construction, the elongated structure has a U-shaped loop transition section which joins the U-shaped supporting loop and the substantially linear inboard section. The U-shaped transition section is also substantially perpendicular to both said U-shaped supporting loop and the substantially linear section.

The interchangeable jewelry assembly includes a securement nut having a centrally disposed aperture for selectively receiving the substantially linear section of the elongated structure in another aspect of the invention. The securement nut is preferably slidably removable from said elongated structure.

According to another specific aspect of the invention, the enlarged outboard end of the elongated structure has a bulbous configuration.

In still another aspect of the invention, the fastening loop affixed to the ornament has a substantially vertical orientation.

Reference will now be made in detail to the present preferred embodiment of the invention, an example which is illustrated in the accompanying drawings.

BRIEF DESCRIPTION OF THE DRAWINGS

The accompanying drawings incorporated in and forming a part of the specification illustrate several aspects of the present invention, and together with the description serve to explain the principle of the invention.

In the Drawings.

Reference will now be made in detail to the present preferred embodiment of the invention, an example of which is illustrated in the accompanying drawings.

DETAILED DESCRIPTION OF THE PREFERRED EMBODIMENT

Figure 1:
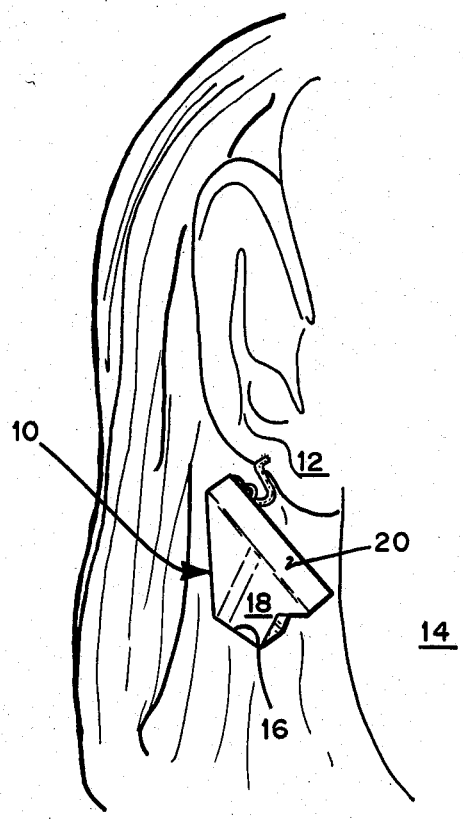
FIG. 1 is a perspective environmental view of an interchangeable jewelry assembly constructed in accordance with the principles of the present invention and used as an earring.

Referring now to the drawings, FIG. 1 depicts an interchangeable jewelry assembly constructed in accordance with the principles of the present invention and generally designated by the numeral 10. As illustrated, the jewelry assembly 10 is suspended from a support, specifically shown as an earlobe 12 of a wearer 14 in FIG. 1. The assembly 10 includes an ornament 16 having a face surface 18, a peripheral side surface 20 and a rear surface 22 (not shown in FIG. 1, see FIG. 2). In use, the ornament 16 would be substantially closer to the earlobe 12 than depicted in FIG. 1, and would obscure the interconnecting member used to connect the ornament to the earlobe. However, for purposes of illustrating the present invention, the spacing between the ornament 16 and the earlobe in FIG. 1 has been greatly exaggerated. Additionally, FIG. 1 shows the U-shaped portion 32 (see FIG. 3) of the interconnecting member proximal to the ornament twisted approximately 90° from its orientation in actual use for clarity of illustration.

Figure 2:
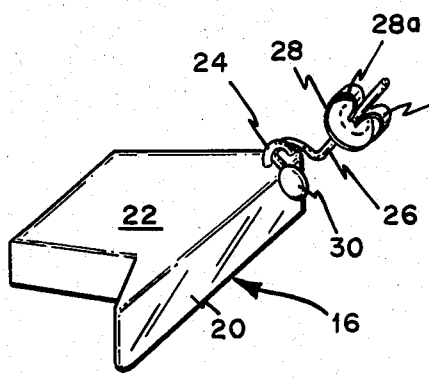
FIG. 2 is a perspective view of the rear surface of the earring assembly depicted in FIG. 1 showing the assembly removed from the wearer and reoriented from its operative hanging position for clarity of illustration.

An accurate fastening loop 24 is shown in FIG. 2 extending from the rear ornament surface 22. This accurate fastening loop 24 has a predetermined internal dimension and, as apparent from viewing FIG. 1 in conjunction with FIG. 2, interconnects with an elongated fastening element 26 to hangingly support the ornament 16 from the earlobe 12. The fastening element 26 extends through a pierced hole (not shown) in the earlobe 12. Although not shown in the illustration of FIG. 1, it will be apparent to those skilled in the art that a securement nut 28, shown in FIG. 2, is circumferentially fitted about the elongated fastening member 26 at a location behind the earlobe 12. This securement nut 28, which is a standard commercially available item, engages the rear side of the earlobe 12 and functions to prevent the elongated fastening element 26 from unintentionally separating therefrom. The elongated fastening member 26 extends through an aperture 29 centrally disposed in the illustrated securement nut 28. The securement nut compressingly engaged about the fastening member 26 and further includes a cooperating pair of wing clamps 28*a* and 28*b* disposed on opposite radial sides of the fastening member 26, which wing clamps 28*a*, 28*b* provide gripping surfaces to assist in sliding the nut onto or off of the elongated fastening member 26.

The outboard end of the elongated fastening element 26, that is the end which extends from the outside surface of the earlobe 12 in FIG. 1, has an enlarged portion 30. This enlarged portion 30, which is shown with a bulbous orientation in the illustrated embodiments, has an external dimension greater than the predetermined internal dimension of the fastening loop 24 so as to prevent the enlarged outboard end 30 from passing through the fastening loop 24.

Figure 3:
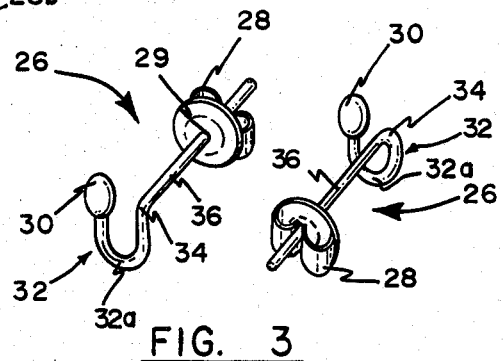
FIG. 3 is a perspective view of a pair of elongated stud fastening elements of the type used with the earring assembly of FIGS. 1 and 2.

Turning now to FIG. 3, a matching pair of stud type fastening elements 26 for securing the jewelry ornament 16 to an earlobe is shown. From observing these matching fastening elements, which are identical to the fastening elements 26 in FIGS. 1 and 2, it will be observed that each of the elongated fastening elements 26 has a serpentine configuration. More specifically, the section of each of the elongated fastening elements proximal to the enlarged bulbous portion is defined by a U-shaped supporting loop 32. Furthermore, this U-shaped supporting loop 32 is perpendicularly joined to the inboard portion of the fastening element 26. In the FIG. 3 embodiment, which is designed as an earring stud, the U-shaped supporting loop 32 joins the inboard portion at a transition point 34, and the entire remaining inboard portion is a substantially linear section 36.

In use, the bulbous end 30 is pointed upwardly and the fastening loop 24, which is then vertically oriented, hangs from the midpoint 32*a* of the U-shaped loop 32. Since the securement nut 28 (as well as friction between the fastening element 26 and the user's earlobe 12) prevents the fastening element 26 from rotating about the axis of the linear section 36, the interconnection between the loop 24 and the fastening element 26 is completely stable in this position. Gravitational forces position the ornament into the proper orientation by urging the fastening loop 24 toward this midpoint 32*a* and prevent sliding movement of the supported ornament 16 on the elongated fastening element 26. In the event that the wearer temporarily bends over and reorients the assembly, sliding movement of the ornament 16 is limited on the inboard end by the earlobe 12 and on the outboard end by the bulbous portion 20. Hence, the ornament is securely mounted to the earlobe regardless of the orientation of the wearer.

Significantly, the fastening loop is vertically oriented in normal usage and extends completely from the rear ornament surface 22, not the peripheral side 20 as is prevalent in the prior art. Furthermore, the fastening loop 24 is spaced from the peripheral sides 20. When this arrangement is combined with the perpendicular orientation of the U-shaped supporting loop 32 on fastening element 26, it is possible to interconnect the fastening element 26 to the jewelry ornament 16 and to substantially block the view of the fastening loop 24 and the fastening element 26 from the face side of the ornament. If desired, the fastening loop may be positioned to expose only the bulbous end portion 30 and a diamond or other decorative stone may be used to form this enlarged end. Thus, the described assemblies provide a simple, readily detachable interconnection which does not disturb the aesthetic qualities of the ornament.

Figure 4:
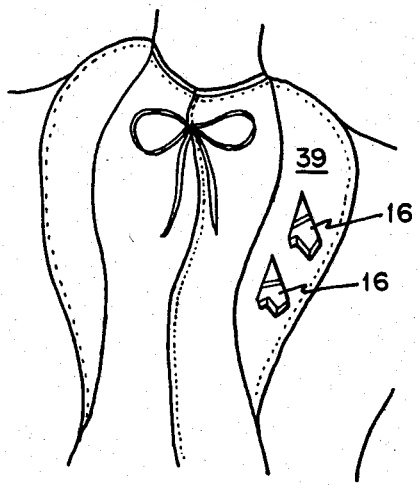
FIG. 4 is a perspective environmental view of the interchangeable jewelry ornament of FIGS. 1 and 2 showing the ornament used as a brooch.
Figure 5:
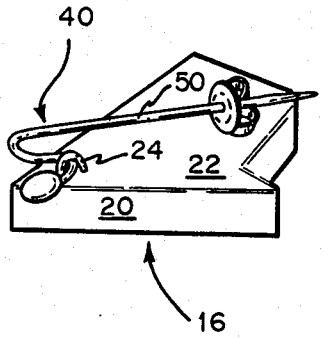
FIG. 5 is a perspective view of the rear surface of the brooch assembly of FIG. 4 depicting an elongated fastening element interconnected with a fastening loop on the rear surface.
Figure 6:
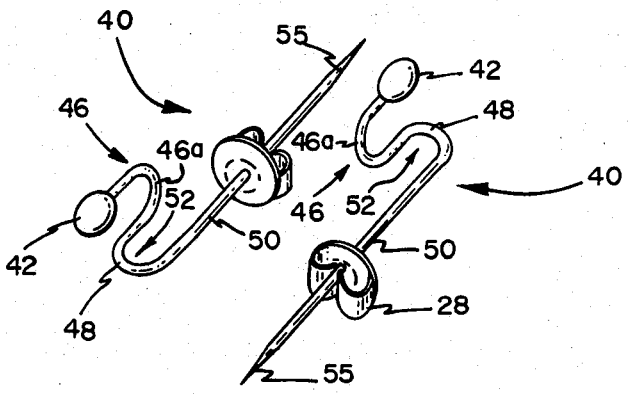
FIG. 6 is a perspective view of a pair of elongated pin fastening elements of the type used in the broach assembly of FIG. 5.

Moreover, as will be observed from FIGS. 4–7, the above-described interconnection between the jewelry ornament 16 and the fastening element 26 will permit the same jewelry ornament 16 to be used in a variety of different ways as a variety of different jewelry pieces. In FIG. 4, for example, two jewelry ornaments 16, which are identical to the earring ornament 16 depicted in FIG. 1, are supported upon the lapel of a wearer's jacket. With reference now being made to FIG. 5, it will be seen that a fastening element 40, similar, but somewhat modified from the previously described fastening element 26, is used to support the ornament 16 on the lapel 39. Like the fastening element 26, the fastening element 40 includes an enlarged outboard end 42 having a dimension greater than the predetermined dimension of the fastening loop 24. Also, like the fastening element 26, the fastening element 40 has a U-shaped supporting loop proximal to the enlarged end 42 which is perpendicularly joined to the inboard portion of the fastening element 40 (see FIG. 6, where this perpendicular relationship is more precisely depicted). In FIG. 6, this U-shaped supporting loop is designated by the numeral 46, and the perpendicular transition to the remaining inboard portion is identified by the numeral 48.

The fastening element 40 also includes a substantially linear inboard section, designated by the numeral 50. However, unlike the fastening element 26, a U-shaped transition loop 52 joins the U-shaped supporting loop 46 of fastening element 40 to the substantially linear section 50. As will be apparent from jointly viewing the depictions of FIGS. 4 and 5, the fastening loop 24 stably rests at the midsection 46*a* of U-shaped supporting loop 46 during use, during which time the linear section 50 is substantially vertical. The inboard end 55 of the fastening element 40 is pointed to give the linear section 50 a pin-like configuration. In this way, the fastening element 40 may be readily inserted into a fabric support such as the illustrated jacket lapel 39. If desired, a securement nut 28 may also be used on the element 40 to prevent the fastening element 40 from separating from the lapel 39. However, when the linear section 50 is substantially vertical with the enlarged outboard end 42 positioned above the pointed end 55, the fastening element 40 will function satisfactorily, in most instances, without the securement nut 28.

Figure 7:
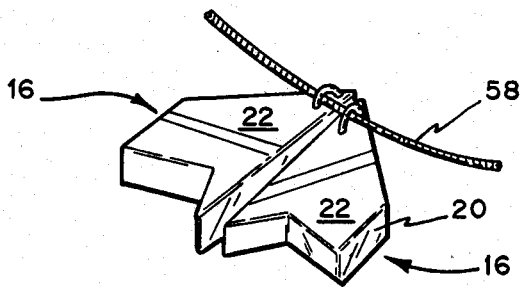
FIG. 7 is a perspective view of the jewelry ornament of FIGS. 1, 2, 4 and 5 showing the ornament used as a necklace hanging.

FIG. 7 shows a pair of the same jewelry ornaments 16 interconnected to a necklace chain 58. Although the chain 58 will likely remain visible during wearing use of a necklace constructed in the manner of that shown in FIG. 7, the interconnecting loops 24 remain virtually hidden from view and do not disturb the aesthetic qualities of the ornament. FIGS. 4 and 7 show how two or more of the ornaments 16 may be combined together to further vary the appearance of the ornaments, either in a spaced arrangement as shown in FIG. 4 or in a juxtapositional arrangement as shown in FIG. 7.

In summary numerous benefits have been described which result from employing the concepts of the invention. The disclosed interchangeable jewelry assembly provides a simple hanging interconnection between a jewelry ornament and the fastening element to permit the jewelry element to be interconnected to a variety of different supports from a variety of different positions. This enables the jewelry ornament to be used as several different types of jewelry pieces. This assembly is particularly advantageous for relatively expensive jewelry ornaments, and permits such expensive ornaments to be more fully utilized by the user. The jewelry assembly is further constructed to substantially obscure the view of the fastening member and the interconnection between the fastening member and the ornament. Furthermore, this arrangement permits an individual jewelry ornament to be combined with one or more additional jewelry ornaments to provide a combined appearance which substantially differs from the appearance of any of the individual jewelry ornaments.

The foregoing description of a preferred embodiment of the invention has been presented for purposes of illustration and description. It is not intended to be exhaustive or to limit the invention to the precise form disclosed. Obvious modifications or variations are possible in the light of the above teachings. For example, a shaped ornament having face view and side surfaces, even if these surfaces are not clearly delineated as in a sphere, may be used. The embodiment was chosen and described in order to best illustrate the principles of the invention and its practical application to thereby enable one of ordinary skill in the art to best utilize the invention in various embodiments and with the various modifications as are suited to the particular use contemplated. It is intended that the scope of the invention be defined by the claims appended hereto.

What is claimed is:

1. An interchangeable jewelry assembly, comprising:

(a) a jewelry ornament, said jewelry ornament including a face surface, a rear surface opposite said face surface, and a peripheral side surface separating said face and rear surfaces;

(b) a fastening loop secured to an upper portion of the rear surface of said jewelry ornament, said fastening loop being disposed in a plane substantially perpendicular to said rear surface and having a predetermined internal dimension; and (c) a fastening element of generally uniform external dimension smaller than said loop internal dimension adapted for interconnecting with said fastening loop to loosely support said jewelry ornament, said fastening element including a single elongated linear portion joined to an end portion arranged in a serpentine configuration, said serpentine end portion terminating in an enlarged outboard end having a dimension greater than the predetermined internal dimension of the fastening loop so as to prevent said enlarged outboard end from passing through said fastening loop, said serpentine end portion of said elongated fastening element proximal to said enlarged end being defined by a U-shaped supporting loop perpendicularly joined to the linear portion of the elongated structure.

2. An interchangeable jewelry assembly as recited in claim 1, wherein the fastening loop lies in a substantially vertical plane when in normal use.

3. An interchangeable jewelry assembly as recited in claim 1, wherein the fastening element has a transition section joining said U-shaped supporting loop and said linear portion, said transition section being substantially perpendicular to said U-shaped supporting loop and said linear portion.

4. An interchangeable jewelry assembly as recited in claim 1 further including a securement nut having a centrally disposed aperture for selectively receiving the linear portion of the fastening element.

5. An interchangeable jewelry assembly as recited in claim 1, wherein the enlarged outboard end of the fastening element has a bulbous configuration.

* * * * *